United States Patent [19]

Kataoka

[11] Patent Number: 4,875,632

[45] Date of Patent: Oct. 24, 1989

[54] WEB DIVIDING AND REWINDING MACHINE AND METHOD FOR REMOVING REWIND ROLLS THEREFROM

[75] Inventor: Hiroshi Kataoka, Iyomishima, Japan

[73] Assignee: Kataoka Machine Co., Ltd., Ehime, Japan

[21] Appl. No.: 178,561

[22] Filed: Apr. 7, 1988

[30] Foreign Application Priority Data

Apr. 9, 1987 [JP] Japan ..... 62-88534
Sep. 4, 1987 [JP] Japan ..... 62-221309

[51] Int. Cl.[4] ..... B65H 17/12

[52] U.S. Cl. ..... 242/56.2; 242/56.9; 242/66

[58] Field of Search ..... 242/56.2, 56.4, 56.9, 242/65, 66

[56] References Cited

U.S. PATENT DOCUMENTS 3,998,399 12/1976 Held et al. ..... 242/56.2 X
4,508,283 4/1985 Beisswanger ..... 242/56.4
4,611,769 9/1986 Orbach ..... 242/56.9

*Primary Examiner*—David Werner
*Attorney, Agent, or Firm*—Bierman and Muserlian

[57] ABSTRACT

Web dividing and rewinding machine includes slitters, a front section and a rear section which are of similar construction and operate in a similar manner, and conveyors. Each section is provided with rewind core holders and a wide web is divided by slitters into longitudinally extending sub-webs. Each sub-web is wound on a rewind core mounted on the holder. Each rewind roll is transferred to a conveyor arranged between the front and rear sections and removed from the machine.

1 Claim, 10 Drawing Sheets

WEB DIVIDING AND REWINDING MACHINE AND METHOD FOR REMOVING REWIND ROLLS THEREFROM

FIELD OF THE INVENTION

This invention relates to a web dividing and rewinding machine for dividing a wide web of sheet material such as, for example, plastic film, paper or metal foil into a plurality of longitudinal cut web strips or sub-webs by means of slitters, supplying each sub-web to a pair of rewinding sections arranged in parallel in a longitudinal direction of the web alternatively, and rewinding each sub-web into a separate roll and a method for removing rewind rolls from the machine.

PRIOR ART

In usual web dividing and rewinding machines such as, for example, disclosed in Japanese Patent Publication No. 33711 of 1978, a pair of rewinding sections are arranged each other in opposite sides of rewind cores, and provided with a plurality of pairs of arms for supporting removably a rewind core between them, each pair of arms being pivotally mounted at their inner ends. In rewinding operation, the sub-web is wound on the rewind core and the arm which is inclined to a contact roller is gradually raised up to separate it from the contact roller in response to the build-up of the rewind roll.

When the rewinding operation of the sub-web is completed, the free end of each arm takes in an upright position, and then is inclined to the opposite side of the contact roller so as to be held in the horizontal position. The rewind roll mounted on the pair of arms is unloaded on a floor, table or truck at the location remote from the contact roller and then the arms from which the rewind roll is removed are raised up to take in a vertical position. The rewind roll on the table or truck is removed from the machine by means of a hoist or other suitable devices.

An overhead traveling crane will be available for removing rewind rolls from the machine, as disclosed in Japanese Patent Publication No. 22773 of 1981. However, it is dangerous to travel a plurality of the rewind rolls which are suspended from the overhead crane above the machine and the rewind roll must be moved through a long distance.

It is quite troublesome to unload the rewind roll from the rewinding machine to the floor or truck and there is a fear of injure or damage the rewind roll. Accordingly, this will reduce the efficiency of the rewinding operation.

OBJECTS OF THE INVENTION

In view of the above, it is a principal object of the present invention to provide a web dividing and rewinding machine which can easily be removed rewind rolls from the machine without suffering damage of the rewind rolls while being removed.

It is an object of the present invention to provide a web dividing and rewinding machine which is so constructed as to remove the rewind rolls quickly from the machine.

It is another object of the present invention to provide a web dividing and rewinding machine in which a large scale of apparatus for removing the rewind rolls therefrom is not required.

It is a further object of the present invention to provide a web dividing and rewinding machine which can be operated at the high speed in safety.

It is an even further object of the present invention to provide a method for removing the rewind rolls from the web dividing and rewinding machine, which may easily be performed.

The above and other objects and features of the present invention will be apparent from a reading of the following description of the disclosure found in the accompanying drawings in which like numerals refer to like parts.

FIRST EMBODIMENT

Figure 1:
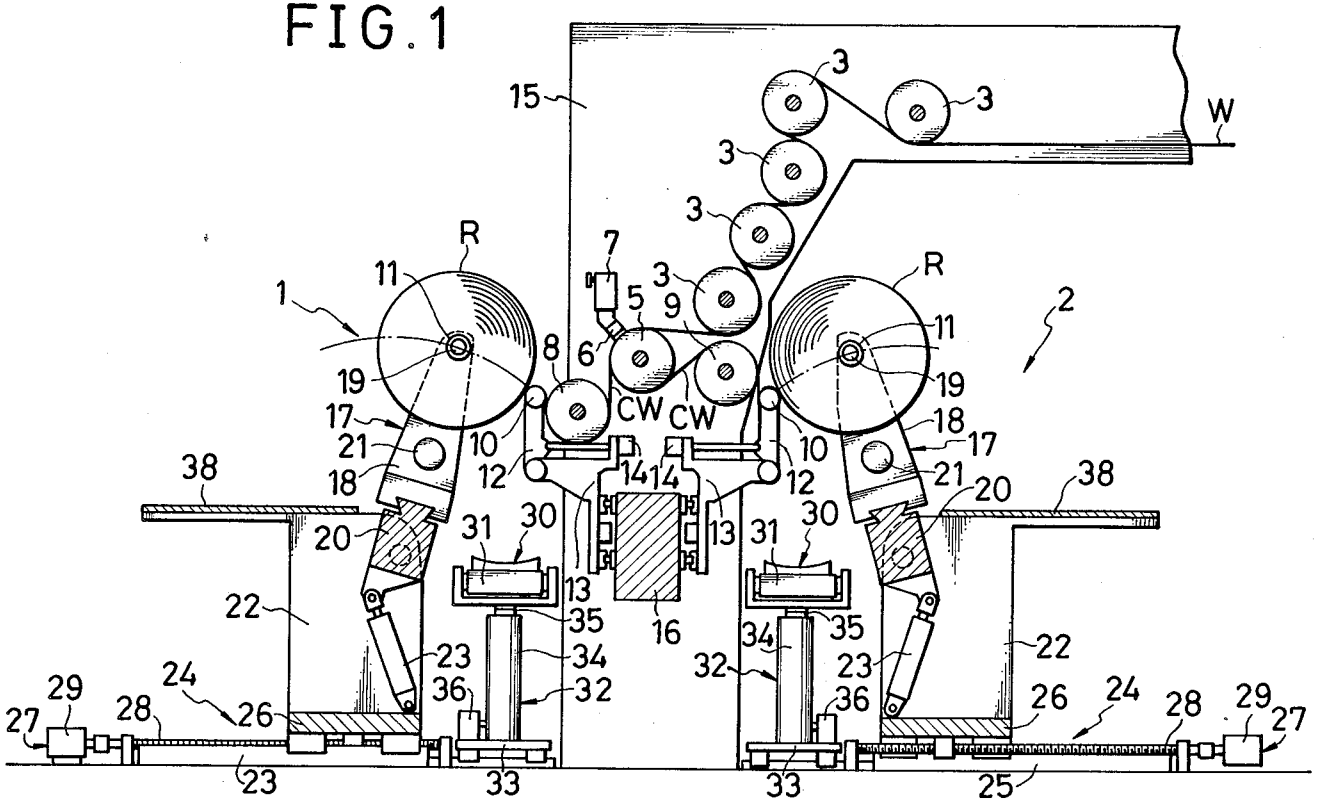
FIG. 1 is a schematic elevation illustrating a first embodiment of the web dividing and rewinding machine according to the present invention.
Figure 2:
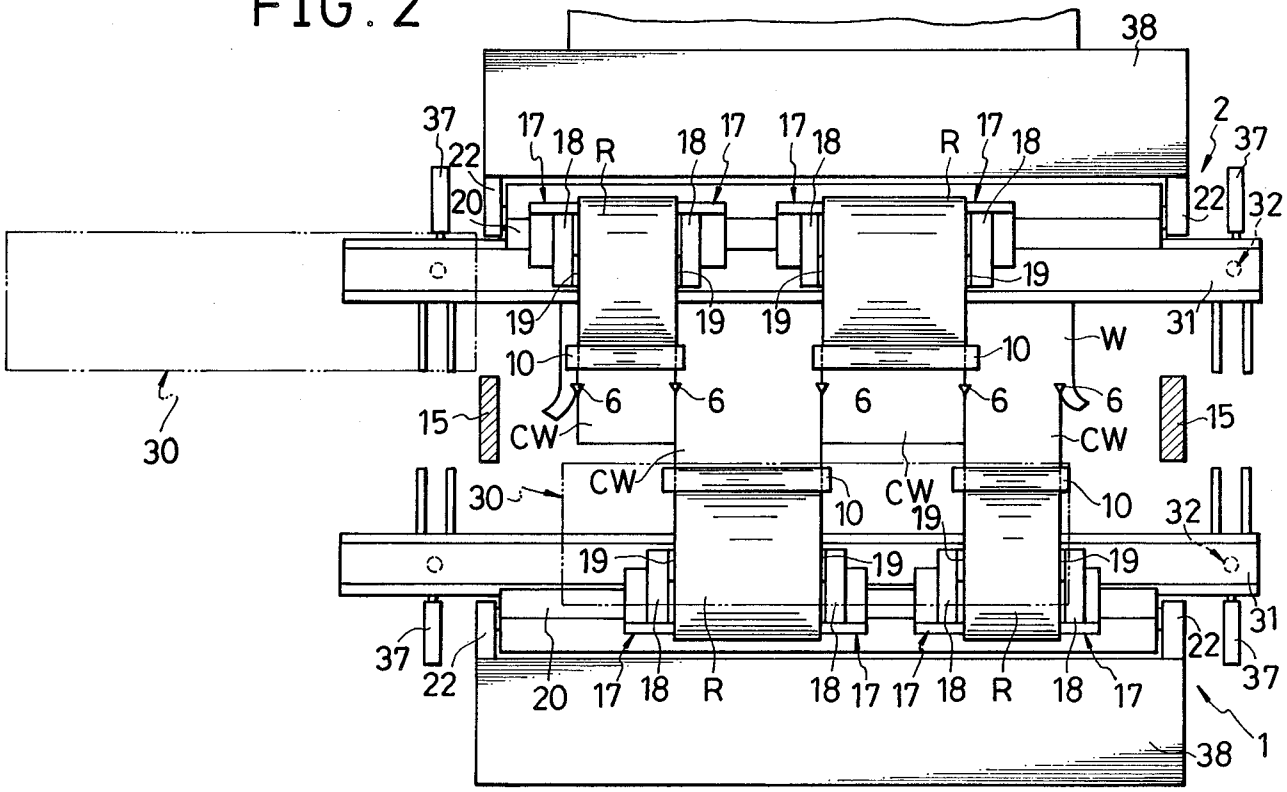
FIG. 2 is a schematic plan view of the machine shown in FIG. 1, parts being broken away for clearness.
Figure 3:
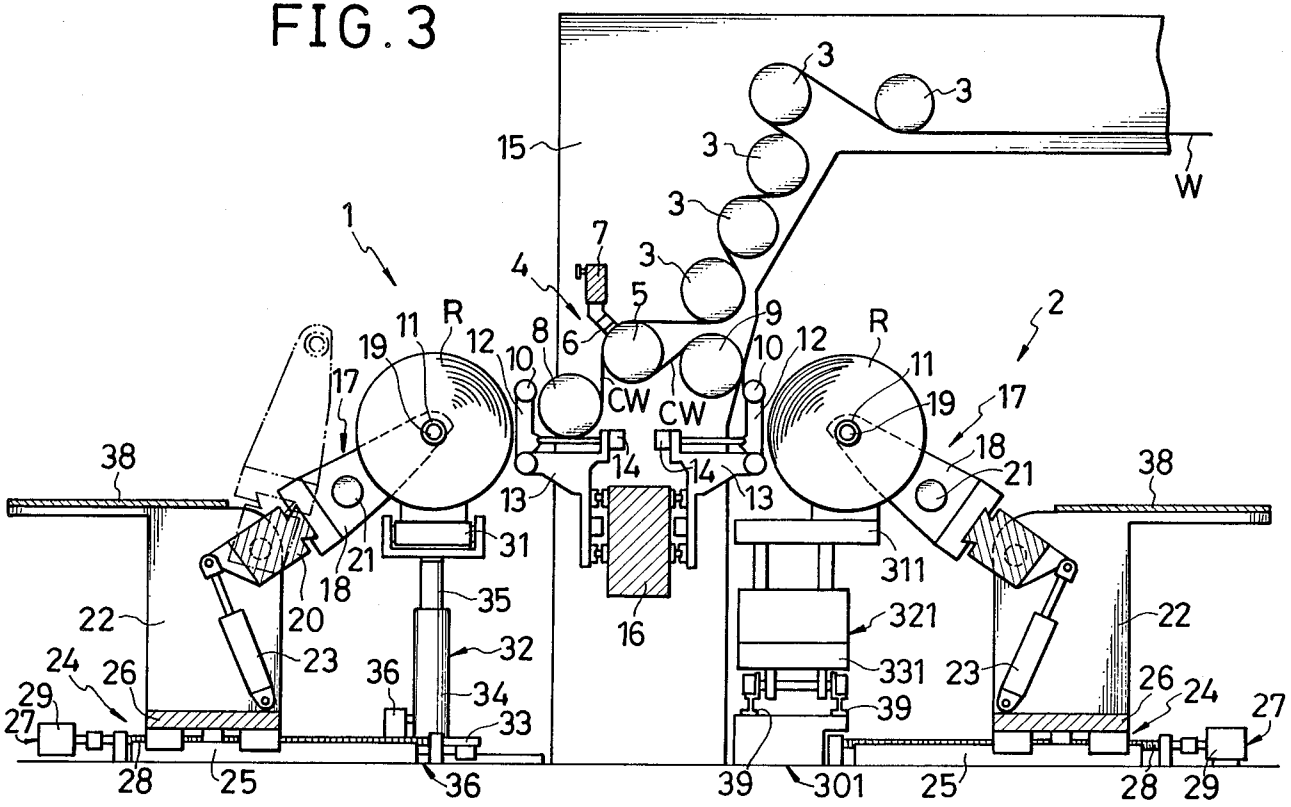
FIG. 3 is a schematic plan view showing a modification of the first embodiment.

Referring now in detail to the drawings, FIGS. 1 through 3 show the first embodiment of the web dividing and rewinding machine of the present invention.

This machine comprises a front section designated generally at 1 and a rear section 2 designated at 2 and are arranged in a longitudinal direction of supply of a relatively wide web W so as to face to face each other. The front and rear sections are of similar construction and operate in a similar manner. The web W is guided to a slitter device 4 passing through a plurality of guide rollers 3. The slitter device 4 is a conventional one and consists of a grooved roller 5 arranged between the front and rear sections 1 and 2 and a plurality of cutter blades 6. Each cutter blade 6 is so arranged to slide on a guide beam 7 which is extended parallel with a longitudinal axis of the grooved roller 5. The cutter blade 6 may be selectively used depending upon the thickness or nature of the web W.

Each cutter blade can be selectively arranged to cut or divide the wide web W into sub-webs CW of the desired rewind width as the web passes therethrough. The sub-webs CW are led alternately guided to a front guide roller 8 in the front section 1 and a rear guide roller 9 in the rear section 2.

There are provided with contact rollers 10 between the front and rear sections 1 and 2. The sub-webs CW supplied to the front guide roller 8 or rear guide roller 9 are respectively guided to a respective rewind core 11 to be wound thereon.

In the first embodiment, the length of the contact roller 10 is adapted for correspond to the width of the sub-web CW and the contact roller 10 is supported by a pair of supporting arms 12 and parallel to a longitudinal central axis of the rewind core 11. The contact roller supporting arm 12 is pivoted to a movable holder 13. The pressure between the contact roller 10 and the rewind roll R can be precisely controlled by means of a hydraulic cylinder apparatus 14 in rewinding operation because the longitudinal central axis of the contact roller 10 mounted on the supporting arms 12 is arranged in parallel to the longitudinal central axis of the core 11.

In order to support a desired length of the contact roller 10 between a pair of arms 12, a holder 13 of each supporting arm 12 is slidably mounted on a guide beam 16 at least both ends of which are secured to a frame 15, and can be fixed fixed to the beam 16 in the desired position.

Each of the rewind cores 11 arranged to the front and rear sections 1 and 2 is supported by a pair of core holders 17. Each core holder 17 is provided with an arm 18 and at the uppermost end of the arm 18, a clamp 19 is arranged to receive the core 11. For the purpose of the clamp 19, it is preferable to use a type of the clamp which has a slide member engaging with the rewind core, which has a member extending through the rewind core and holding the outer surface thereof, or which has a member fixed to the arm and engaging with the rewind core.

To wind a desired width of the sub-web CW on the rewind core 11, the base of the core holder 17 can be slid on a distance adjusting member 20 in parallel with a longitudinal axis of the core and fixed thereto in a desired position. In a desired position of each of the front and rear section 1 and 2, there is provided with a driving means 21 an output shaft thereof is connected through suitable mechanisms to the rewind core 11 to wind up the sub-web CW thereon.

The driving means 21 controls tension of the sub-web CW to be wound and is preferably selected from, for example, a DC or AC motor, hydraulic engine, magnetic clutch, etc.

In the first embodiment of the present invention, the core holder 17 allows to contact the contact roller 10 with the rewind roll R and to maintain the contact roller 10 in a certain position in operation of the machine as the sub-web CW is wound around the core 11 and the rewind roll R increases in diameter.

To this end, the distance adjusting member 20 is rotatively supported between a pair of frames 22 and can be turned within a certain range of angle in operation of a driving means 23 thereby the arms 18 of the distance adjusting member 20 can be pivoted. Accordingly, the core 11 mounted on the arm 18 can be rotated about a central axis thereof and moved gradually away from the contact roller 10 when the distance adjusting member 20 is driven by the moving means 23.

Each of the front and rear section 1 and 2 is provided with a driving device 24 for moving the core holder 17 in a longitudinal direction of the web W. The driving device 24 includes rails 25 extending in a longitudinal direction of the web W, a slide body 26 to be supported on the rails 25 and a driving means 27 for the slide body 26.

The driving means 27 includes a screw rod 28 which engages with the slide body 26 and a motor 29 for rotating the screw rod 28 clockwise or counterclockwise. It is possible to use a truck instead of the slide body 26 and to use a hydraulic means instead of the driving means 27. The frames 22 arranged to at the both ends of the distance adjusting member 20 are fixed to the slide body 26. The core holder 17 is approached to or moved away from the contact roller 10 together with the frames 22 and the distance adjusting means 20 as the slide body 26 is moved forward or rearward.

In the first embodiment of the present invention, at the start of rewinding operation, the arms 18 of the holder 17 are inclined to contact with the contact roller 10, the core 11 winds the sub-web CW and in response to the increase of the diameter of the rewind roll R, the arms 18 are gradually raised up to take into an upright position. In this operation, the frames 22 of the driving device 24 are held in a fixed position. Consequently, at the under side of the arm 18 of the core holder 17 of each of the front and rear sections 1 and 2, a free space is formed to install the carrying apparatus 30 for removing the rewind rolls R from the machine.

The carrying apparatus 30 of each of the front and rear sections includes a conveyor 31 for transferring the rewind rolls in the longitudinal direction of its central axis and an elevator 32 for moving up and down the conveyor 31. The elevator 32 is supported by a pair of inner cylinders 35 each of which is slidably mounted in an outer cylinder 35 mounted on a movable member 33. Instead of the above type of the elevator, a conventional elevating means may be used. It is possible to provide a means for controlling the level of the conveyor 31 so as to reduce the load of the rewind roll R to be applied on the lower side of the rewind roll R when the rewind rolls R are received to the conveyor 31. Also the carrying apparatus 30 can be constructed to move by the operation of a driving means 37 such as a hydraulic means between its stand-by position and a position for receiving for receiving the rewind roll R along rails which are laid on the floor extending to the transverse direction to the longitudinal axis of the rewind roll R.

The operation of the first embodiment will be explained with reference to FIGS. 1 and 2 showing that the sub-webs CW are wound on each of the front and rear sections 1 and 2. When a desired length of the sub-web is wound on the core, the rewind operation is stopped. The core holder 17 is moved to a desired position together with the frame 22 and the distance adjusting member 20 by operation of the moving 24 and the rewind roll R mounted on the core holder 17 is inclined to the side of the contact roller 10 in operation of the driving device 24 without being interrupted by the contact roller 10. Thus the core holder 17 is moved to form a space for installing the conveyor 31 in the lower side of the rewind roll R. Then the conveyor 31 is moved to just under the rewind roll R in operation of the driving means 37 and lifted to receive the rewind roll R in operation of the elevator 32, as shown in FIG. 3.

In operation of the clamp 19 of the core holder 17, the rewind roll R is released from the core holder 17 together with the core 11. The arms are taken in an upright position in operation of the moving means 23 and removed from the position of the rewind roll R, as shown in two dotted line in the left side of FIG. 3, to prepare a space for carrying the rewind roll R in its longitudinal direction. Then the rewind rolls R on the conveyor 31 are moved in the direction of a longitudinal axis of the rewind roll R. At one of the ends of the conveyor 31, there is provided with another conveyor or a roll receiving means, not shown, for receiving the rewind rolls R from the conveyor 31. Thus the rewind roll R is removed from the machine.

During a period of time for removing the rewind rolls R from the machine, the operator can mount fresh rewind cores on the holders 17 for ready to the next rewinding operation.

In FIG. 2, the carrying apparatus 30 in the front section 1 is in the removed position as designated at reference numeral 30A, but the carrying apparatus 30 in the rear section 2 remains in its origninal position.

When the removal of the rewind rolls R on the conveyor 31 has been completed, the operation of the conveyor 31 is stopped, and the conveyor 31 is lowered down in operation of the elevator 32, and retired to its stand-by position. Then the core holder 17 is moved to the the contact roller 10 together with the frame 22 in operation of the driving device 24. The core holder 17 is inclined to take the rewind core 11 in its rewind position in operation of the moving means 23. After the end of the fresh subweb CW has been adhered to the rewind core 11, the rewinding operation of the machine is started again.

In the right side of FIG. 3, there is shown a carrying apparautus 301 instead of the carrying apparatus 30 shown in the left side. The carrying apparatus 301 includes a truck 331 which can be moved along rails 39 laid on the floor and extending through both sides of the rear section 2 in parallel with the direction of width of the web W and elevator 321 mounted on the truck 331, and a rewind roller receiving member 311 mounted on the elevator 321. During the rewinding operation, the truck 331 is positioned on rails and then receives the rewind roll R in the same manner as described above with respect to the carrying apparatus 30.

SECOND EMBODIMENT

Figure 4:
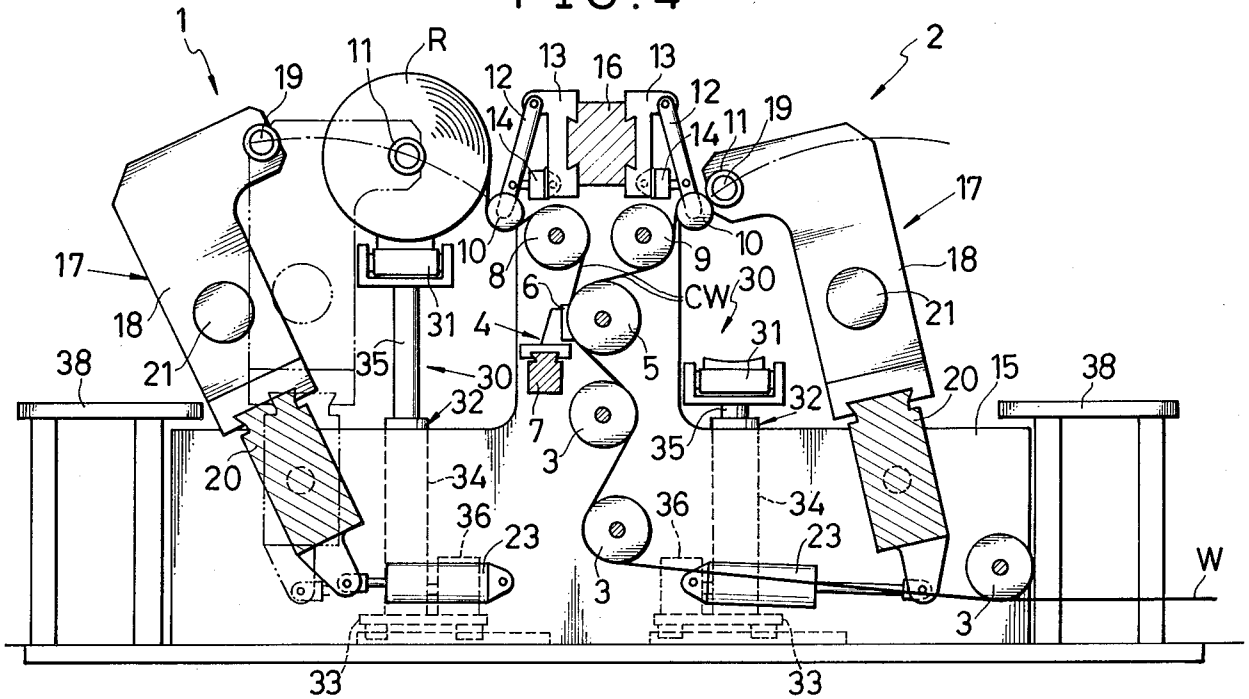
FIG. 4 is a schematic elevation of a second embodiment of the machine according to the present invention.
Figure 5:
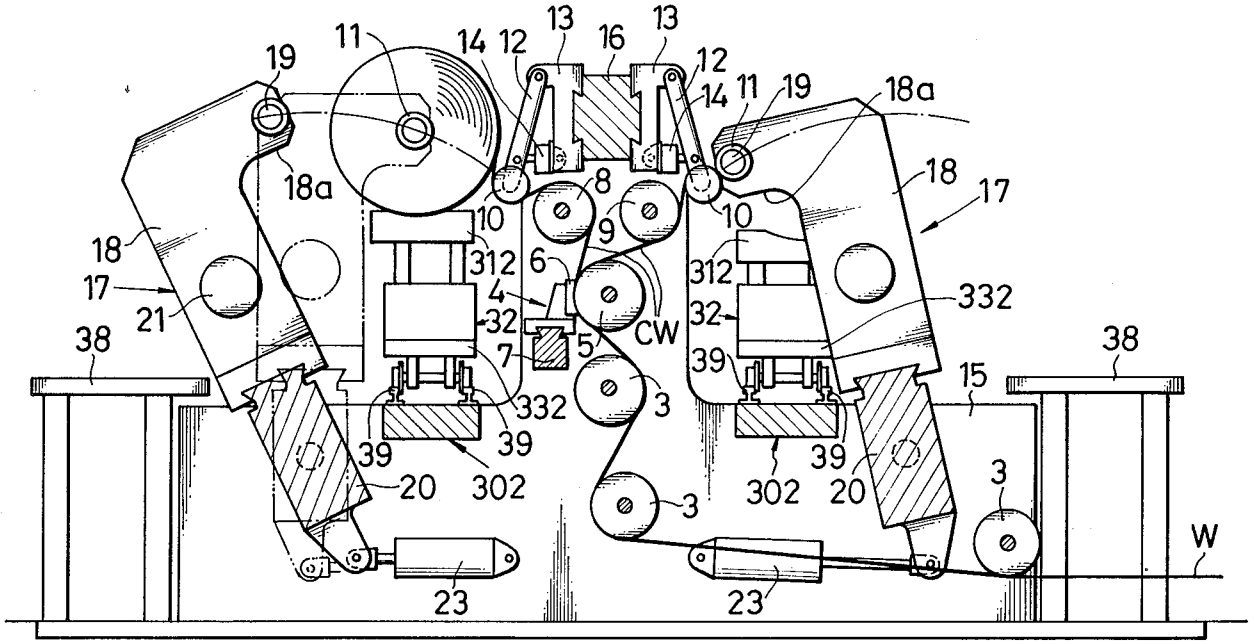
FIG. 5 is a schematic elevation illustrating a modification of the second embodiment according to the present invention.

Referring to FIGS. 4 and 5 illustrating a second embodiment of the present invention, in which a set of guide rollers 3 are arranged at the lower part of the rewinding machine and the web W is guided from the underside of the machine to the slitters 4 passing through the guide rollers 3. In this embodiment, the driving device such as shown in the first embodiment has not been provided and both ends of the distance adjusting member 20 are supported by the frame 15 which supports the beam 16 and guide rollers 3. The core holder 17 includes arms 18 each of which has an inwardly protruding portion 18*a* at its uppermost end. The protruding portion 18*a* is provided with a clamp 19.

In the second embodiment, mechanisms for rewinding the subwebs CW in each of the front and rear sections 1 and 2 are substantially the same as the mechanisms of the first embodiment, but the moving means 23 for separating the rewind core 11 from the contact roller 10 can be inclined outwardly whereby the protruding portion 18*a* may be retired from the rewind roll R received on the carrying apparatus 30, as shown in the left side of FIG. 4.

In this embodiment, the carrying apparatus 30 is arranged under the protruding portion 18*a* and is of similar construction and operates in a similar manner of the carrying apparatus described in the first embodiment.

In FIG. 4, a retired position of the conveyor 31 is shown in the right side and the position for removing the rewind roll R from the machine is shown in the left side.

After the reweinding operation has been completed so that the core holder 17 takes in its upright position, and the rewind roll R has been positioned to be removed therefrom, as shown in FIG. 4, the conveyor 31 is moved to the underside of the rewind roll R to receive it thereon. Then the rewind roll R is released from the core holder 17 in operation of the clamp 19 and transferred to the conveyor 31.

The core holder is then inclined outwardly and the protruding portion 18*a* of the arm 18 is removed from the rewind roll R so that the roll R is moved in the direction of the longitudinal axis of the core to the outside of the machine. According to the second embodiment, t is possible to reduce the floor space of the machine.

As shown in FIG. 5, a modified carrying apparatus 302 instead of the carrying apparatus 30 is installed in a space between the contact rollers 10 of the front and rear sections 1 and 2. The carrying apparatus 302 includes a truck 332 moving along the rails 39, and elevator 322 mounted on the truck 332, and a table 312 for receiving the rewind roll R. The carrying apparatus 302 can remove the rewind roll R from the machine in the same manner as described in the carrying apparatus 30 of the first embodiment shown in FIG. 1.

THIRD EMBODIMENT

Figure 6:
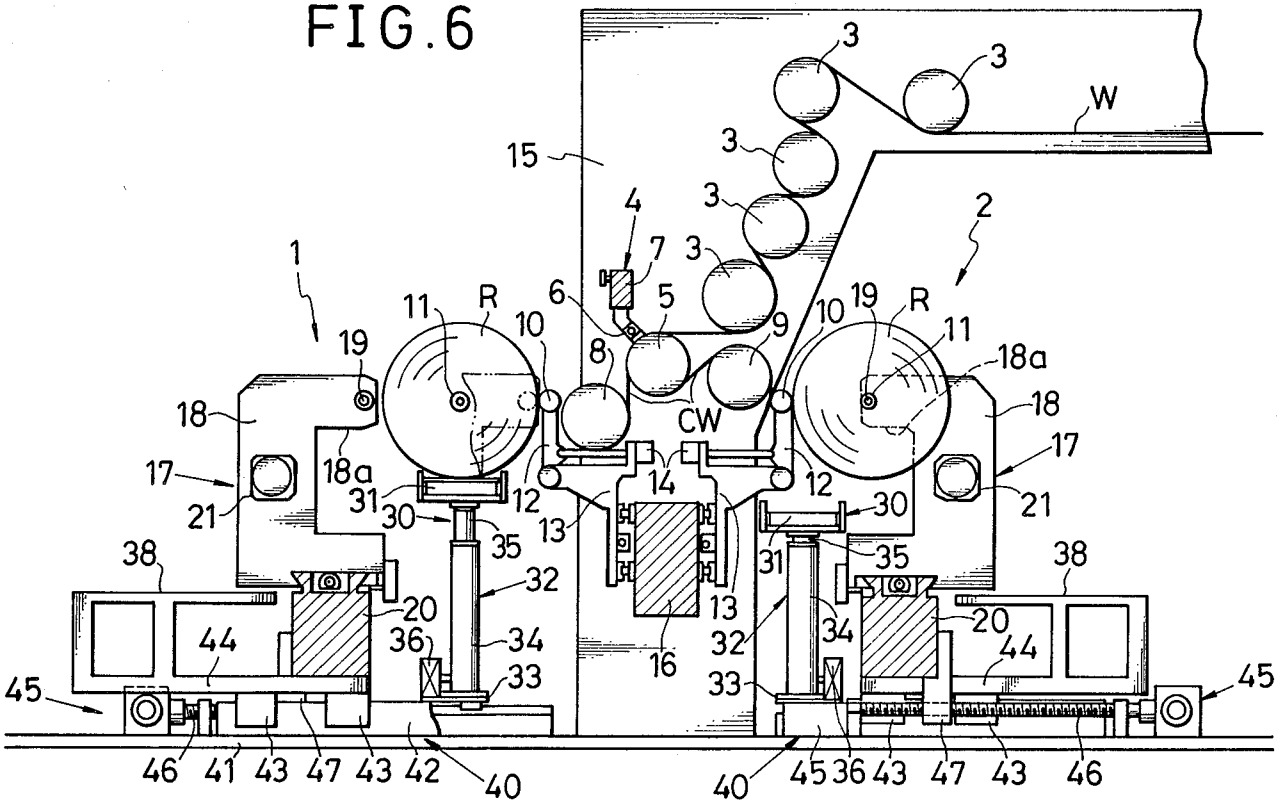
FIG. 6 is a schematic elevation illustrating a third embodiment according to the present invention.

A third embodiment of the web dividing and rewinding machine according to the present invention will be explained with reference to FIGS. 6 and 7.

This machine is suitable for producing rewind rolls in good quality.

In this embodiment, each of the front and rear sections 1 and 2 is provided with a pair of arms 18 each of which has a protruding portion 18*a* at the uppermost end which extends inwardly toward a contact roller 10. The protruding portion 18*a* is provided with a clamp for removably mounting a rewind core 11. The base portion 18*b* of the core holder 17 is mounted on a distance adjusting member 20 in the same manner as in the first embodiment shown in FIG. 1.

In the conventional web dividing and rewinding machine, the core holder is moved angularly so as to separate the rewind core from the contact roller. Consequently, in such machine the rewind rolls are easily subjected to mechanical vibration in operation.

Accordingly, in order to suppress or eliminate the vibration of the machine and the rewind roll, the core 11 and the core holder 17 in the third embodiment of the present invention are linearly moved to separate the core 11 from the contact roller 10. To this end, each of the front and rear sections 1 and 2 is provided with a plurality of guide means 40 for guiding the core holder 17 in a parallel with a longitudinal direction of the web W. Each guide means 40 is fixed to a base member 41, and includes rails 42 extending parallel to the longitudinal axis of the web W and leg portions 43 engaging with the rail 42. The leg portion 43 is formed to embrace the head of the rail 42. To the leg portion 43 a base member 44 is fixed and a distance adjusting member 20 is also fixed to the base member 44. Each of the front and rear sections 1 and 2 is provided with a driver 45 for moving the core holder 17 mounted on the guide means 40 together with the distance adjusting member 20 in a longitudinal direction of the web W.

Figure 7:
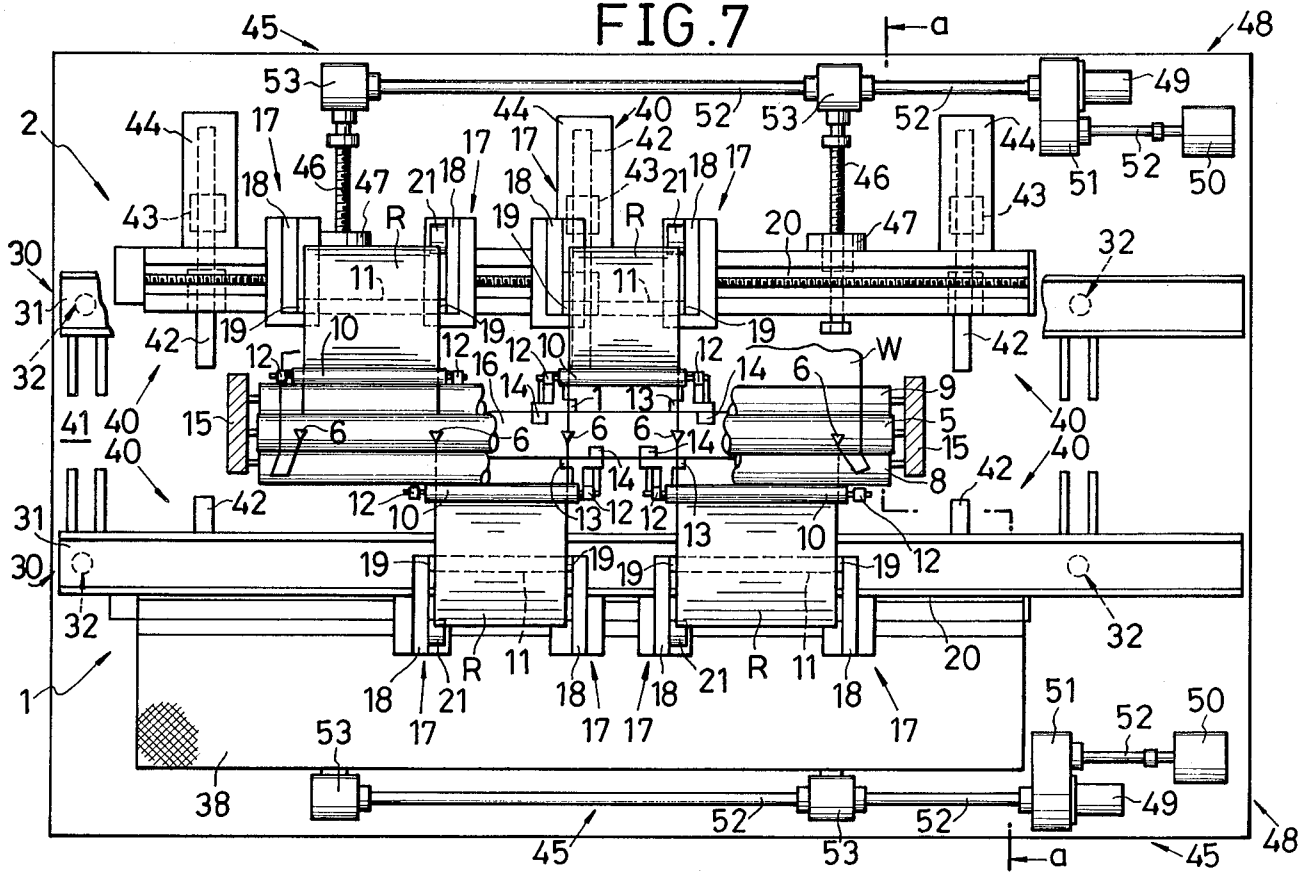
FIG. 7 is a schematic plan view of the machine shown in FIG. 6, parts being broken away for clearness.

As shown in FIG. 7, the driver 45 includes a screw shaft 46 which is arranged in the lower part of the distance adjusting member 20, means 47 for engaging with the screw shaft 46 and a driving means 48 for rotating the screw shaft 46 clockwise and counterclockwise. The screw shaft rotating means 48 includes a servomotor 49 which acts to separate the core holder 17 from the contact roller 10 in rewinding operation and a motor for moving the core holder 17 at a high speed when the machine is operated other than rewinding. The output of the motor 49 is transmitted to the screw shaft 46 through a differential gear 51, a driving shaft 52, and a gear box 53. In rewinding operation, in response to the increment of the rewind roll R, the rewind roll R is in contact with the contact roller 10 in operation of the servomotor 49 and the rewind core 11 is linearly moved so as to remove from the contact roller 10. The carrying apparatus 30 to be used in the third embodiment of the invention is of the same as the carrying apparatus 30 in the first embodiment.

FOURTH EMBODIMENT

Figure 8:
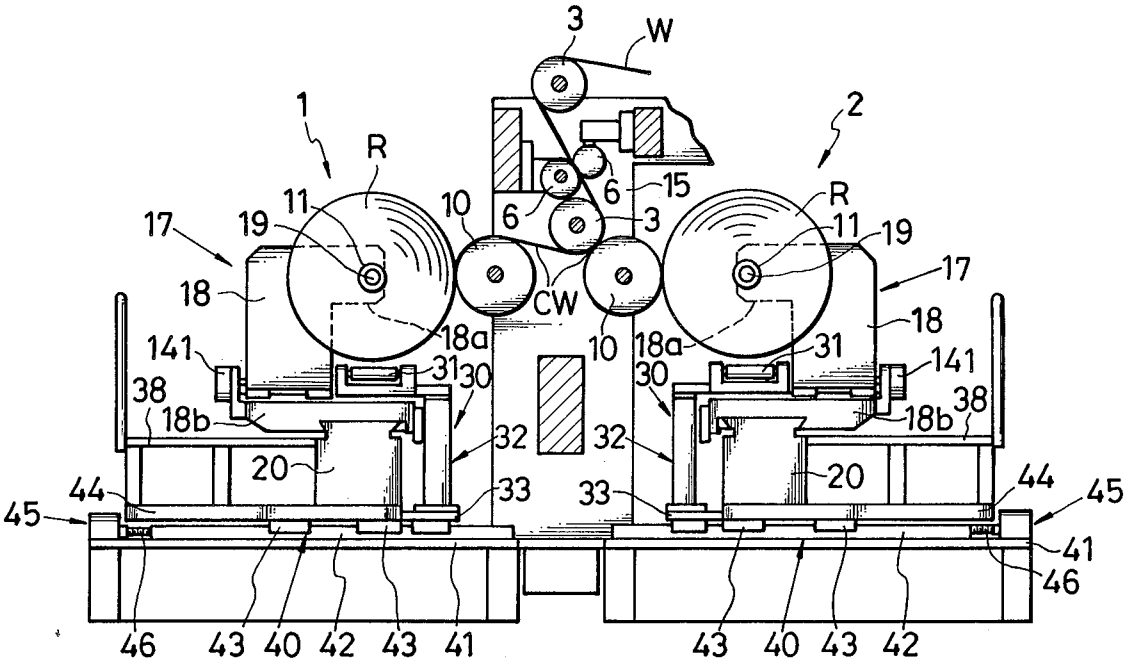
FIG. 8 is a schematic elevation illustrating a forth embodiment according to the present invention.

Referring now to FIG. 8 which shows a forth embodiment of the web dividing and rewinding machine according to the present invention, each of the front and rear sections 1 and 2 is contacted with a single roller 10 which is arranged in a fixed place so as to cooperate with a plurality of separate rewind rolls R. of the rewind roll R arranged between the front and rear sections. The contact roller 10 is supported to a fixed position and in order to adjust the contact pressure between the contact roller 10 and the rewind roll R, the core holder 17 supports the arm 18 having a protruding portion 18*a* so as to slide it in parallel with a longitudinal direction of the web W. The arm 18 is pressed against a base 18*b* of the core holder 17 by means of a hydraulic means 141.

In the lower part of each of the front and rear sections 1 and 2, there is provided with a driver 45 for moving the core holder 17 together with a distance adjusting member 20. By means of the driver 45 the base 18*b* of the core holder 17 can be separated from the contact roller so as to maintain the arm 18 in a desired position relative to the base 18*b*.

The carrying apparatus 30 of the fourth embodiment is provided with more than three sets of elevators 32 which are separated each other at a desired distance along a longitudinal direction of the conveyor 31 whereby it is possible to handle a wide and heavy web W.

FIFTH EMBODIMENT

Figure 9:
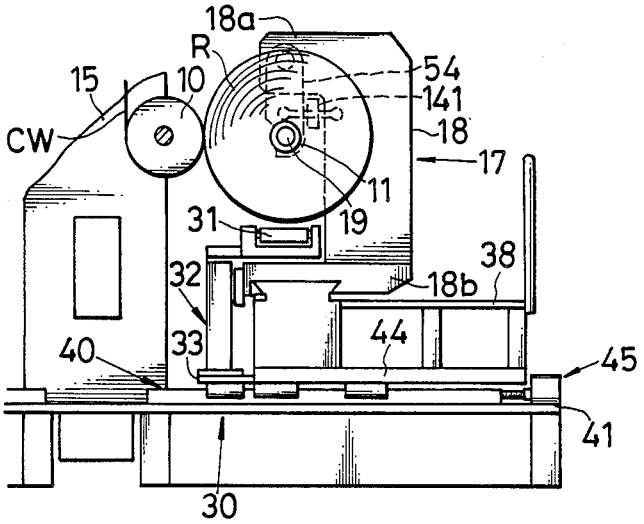
FIG. 9 is a schematic elevation of a portion illustrating a fifth embodiment of the present invention.

FIG. 9 shows the rear section 2, a contact roller 10 and a carrying apparatus 30 of a fifth embodiment according to the present inventon.

In this embodiment, a core holder 17 is provided with an arm 18 having a protruding portion 18*a* which is extending inwardly at the top end of the arm 18, and a lever 54 which is pivoted to and suspended from the outer end of the protruding portion 18*a*. The clamp 19 for removably mounting the rewind core 11 is arranged at the lower end of the suspended lever 54. Between the arm 18 and the suspended lever 54 a hydraulic means 141 is arranged to control the contact pressure between the contact roller 10 and the rewind roll R.

According to the fifth embodiment, it is possible to adjust the contact pressure between the contact roller 10 and the rewind roll R precisely.

SIXTH EMBODIMENT

Figure 10:
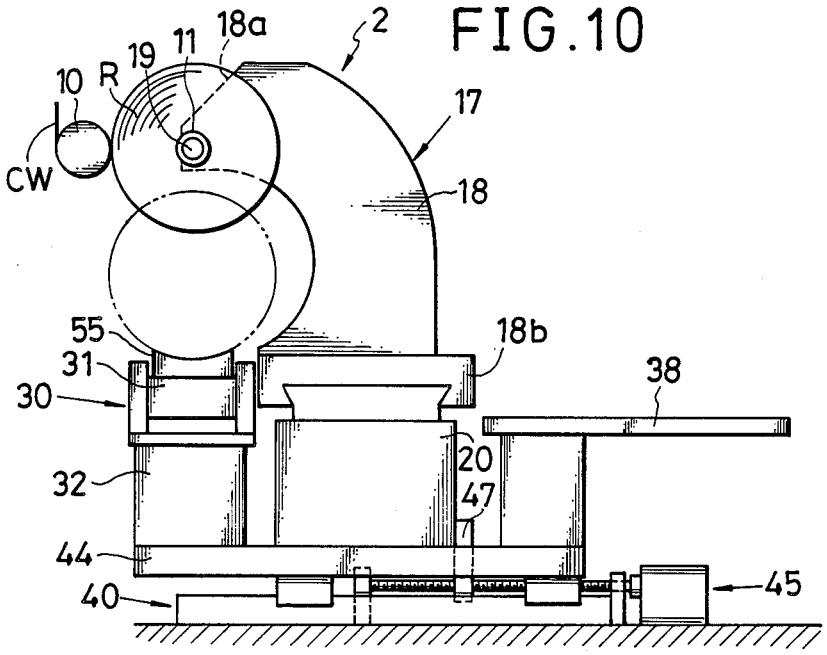
FIG. 10 is a schematic elevation illustrating a portion of a sixth embodiment of the present invention.

FIG. 10 shows a sixth embodiment of the present invention in which a core holder 17 has a protruding portion 18*a* extending inwardly from the top portion of an arm 18. The arm 18 is formed to provide a space to be for removing the rewind roll R from the machine.

The carrying apparatus 30 includes elevators 32 mounted on the base member 44 supporting the distance adjusting member 20. The elevator 32 is positioned directly below the end of the protruding portion 18*a*. The carrying apparatus 30 moves together with the core holder 17 mounted on the distance adjusting member 20 and the conveyor 31 is positioned directly below the rewind roll R at all times. When the rewinding operation is completed, the conveyor 31 is raised up to receive the rewind roll R. The conveyor 31 may be provided with a pallet 55.

When the rewind roll R is released from the core holder 17, the conveyor 31 is lowered down in operation of the elevators 32 and the rewind roll R is lowered down together with it, as shown in a dotted line of FIG. 10.

SEVENTH EMBODIMENT

Figure 11:
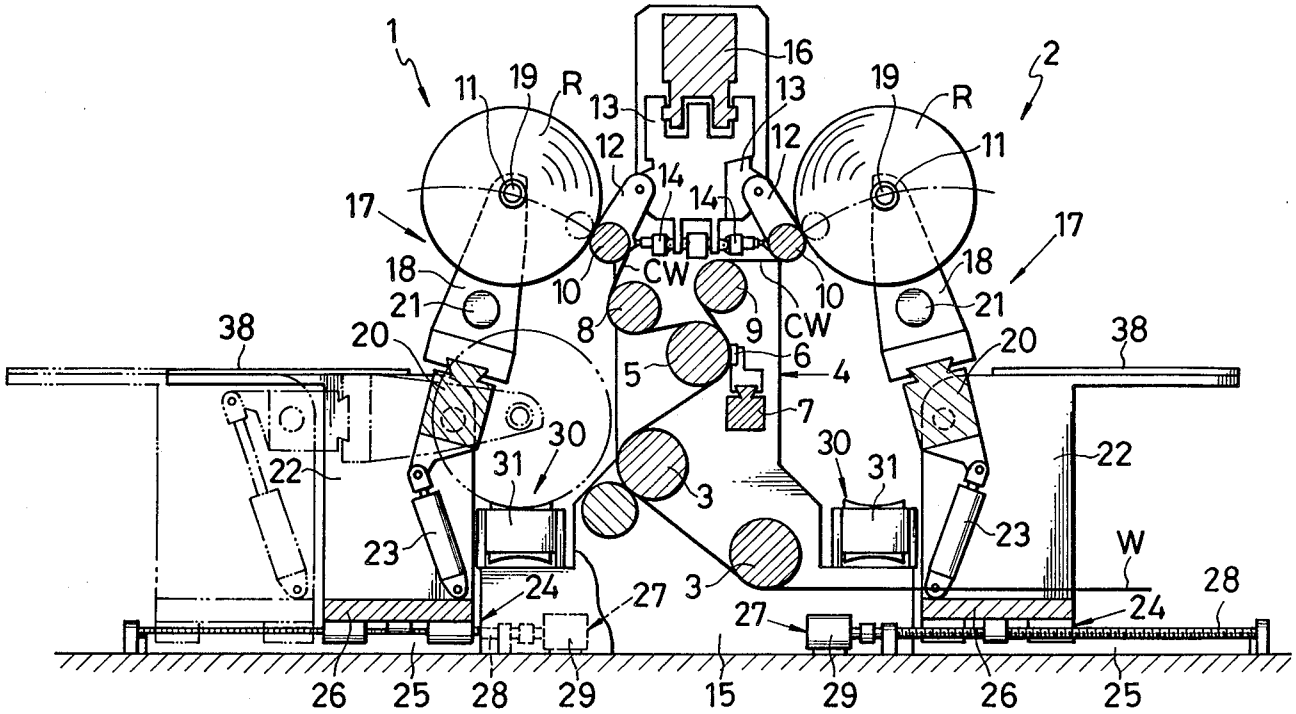
FIG. 11 is a schematic elevation explaining a seventh embodiment according to the present invention.

FIG. 11 illustrates a seventh embodiment of the web dividing and rewinding machine according to the present invention. In this embodiment a relatively wide web W can be guided to the slitters 4 through a plurality of guide rollers 3 arranged at the lower portion of the machine. The carrying apparatus 30 includes a conveyor 31 fixed to the frame 15. The same type of the conveyor 31 as shown in the first embodiment can be employed in this embodiment.

Essentially, each of the front and rear sections 1 and 2 in the seventh embodiment is of the same construction as those shown in the first embodiment, but in this embodiment, the arm 18 of the core holder 17 can be inclined greater than that of the first embodiment in order to receive the rewind roll R from the core holder 17 with certainty. While the invention has been described in preferred embodiments, it is to be understood that various changes and modifications may be made without departing from the spirit or scope of the following claims.

What is claimed is:

1. A web dividing and rewinding machine comprising a front section and a rear section which are similar construction and operate in a similar manner, a plurality of slitters for dividing a wide web into a plurality of elongated longitudinal sub-webs, a plurality of pairs of rewind core supporting arms mounted on a core holder arranged in each of the front and rear sections, a rewind core supported on each pair of the rewind core supporting arms for rewinding said sub-web thereon, said rewind core being rotated in contact with a contact roller, means for moving said rewind core supporting means in a longitudinal direction of said web, and a pair of carrying apparatus, each of which includes a conveyor for transferring the rewind rolls wound on the rewind core in the longitudinal direction of the central axis of the roll and an elevator for moving up and down the conveyor, each said carrying apparatus being arranged in a space between the front and rear sections and installed at the under side of said rewind core holder for removing rewind rolls from the machine.

* * * * *